US007703311B2

(12) United States Patent
Agbay

(10) Patent No.: US 7,703,311 B2
(45) Date of Patent: Apr. 27, 2010

(54) KEY SYSTEM FOR A ROTATING BARREL LOCK

(75) Inventor: Anthony John Agbay, Spencer, MA (US)

(73) Assignee: Inner-Tite Corp., Holden, MA (US)

( * ) Notice: Subject to any disclaimer, the term of this patent is extended or adjusted under 35 U.S.C. 154(b) by 0 days.

(21) Appl. No.: 11/934,237

(22) Filed: Nov. 2, 2007

(65) Prior Publication Data

US 2008/0105013 A1 May 8, 2008

Related U.S. Application Data

(60) Provisional application No. 60/864,257, filed on Nov. 3, 2006.

(51) Int. Cl.
*E05B 19/06* (2006.01)
*E05B 29/04* (2006.01)

(52) U.S. Cl. ..... 70/366; 70/340; 70/389; 70/409

(58) Field of Classification Search ..... 70/366, 70/409, 337–343, DIG. 1, DIG. 2, 377, 356, 70/365, 389

See application file for complete search history.

(56) References Cited

U.S. PATENT DOCUMENTS

| | | | | | |
|---|---|---|---|---|---|
| 2,217,047 | A * | 10/1940 | Fitzgerald | ..... | 70/366 |
| 2,862,380 | A * | 12/1958 | Welch | ..... | 70/366 |
| 3,789,638 | A * | 2/1974 | Roberts et al. | ..... | 70/366 |
| 3,797,290 | A * | 3/1974 | Taylor | ..... | 70/366 |
| 3,797,292 | A * | 3/1974 | Taylor | ..... | 70/409 |
| 3,848,442 | A * | 11/1974 | Mertanen | ..... | 70/366 |
| 4,742,703 | A * | 5/1988 | DeWalch et al. | ..... | 70/366 |
| 5,086,631 | A | 2/1992 | Agbay | | |
| 5,388,438 | A * | 2/1995 | Haavikko Paavo | ..... | 70/366 |
| 5,490,405 | A * | 2/1996 | Ramo et al. | ..... | 70/366 |
| 5,613,389 | A * | 3/1997 | Hauser | ..... | 70/366 |
| 6,591,645 | B1 * | 7/2003 | Wittwer | ..... | 70/366 |

* cited by examiner

*Primary Examiner*—Lloyd A Gall
(74) *Attorney, Agent, or Firm*—McCormick, Paulding & Huber LLP

(57) ABSTRACT

A key system including a key for use with a barrel lock having a rotating locking mechanism. The key includes a grip portion and a shank portion operatively attached to the grip portion. The shank portion includes at least one cam surface for rotatably engaging the rotating locking mechanism to permit rotation of the mechanism in one of a clockwise or counterclockwise direction, but not the other direction, to lock the barrel lock.

22 Claims, 14 Drawing Sheets

KEY SYSTEM FOR A ROTATING BARREL LOCK

CROSS REFERENCE TO RELATED APPLICATIONS

This application claims priority to U.S. Provisional Application No. 60/864,257, filed on Nov. 3, 2006, titled "ROTATING BARREL LOCK WITH LOCKING KEY," which is hereby incorporated by reference in its entirety.

FIELD OF THE INVENTION

The present invention relates generally to a key system for a rotating barrel lock and more particularly to a key system that allows the barrel lock to be delivered to installers in an unlocked state and also allows installers to lock but not unlock the barrel lock thereby reducing key costs and providing an increased level of security.

BACKGROUND OF THE INVENTION

Utility boxes, such as electric meter boxes, are typically secured to prevent unauthorized access to the meter. Many of such boxes are secured through the use of split ring that is placed directly around the meter and locked through the use of a barrel lock. Other utility boxes, referred to as "ringless" boxes, do not include a lockable meter ring. Ringless boxes are secured by securing a lock assembly containing a barrel lock on either a side wall or a bottom wall of the box.

A preferred type of barrel lock for use with the above-described utility boxes is known as a rotating disk barrel lock. These locks include multiple rotating combination disks that, when rotated into the proper position via a key, will open the lock. Known barrel locks include relatively complicated working surfaces on the rotating disks, and correspondingly complicated key surfaces, to obstruct attempts at picking the lock. An example of such a rotating disk barrel lock is described in U.S. Pat. No. 5,086,631, which is hereby incorporated by reference in its entirety.

To remove a key from known rotating disk barrel locks, the key must be rotated to a locked position. This rotates a cylinder of the lock to a locked position and scrambles the rotating disks in such a way that a lock keyway is formed allowing the key to be withdrawn.

In view of the above, known rotating disk barrel locks are delivered for installation in a locked state. As will be appreciated, in order to install these locks, they must be first unlocked with a key, installed in a split ring or a body of a ringless box lock, and then relocked.

As will be appreciated, this requires installers to carry a key capable of both locking and unlocking the barrel lock. These keys are relatively complex with intricate cam surfaces, expensive and, if lost or stolen, could potentially threaten the security of an entire utility system, which typically utilizes a single lock and key for a system. Moreover, the installation process is unnecessarily complicated by the fact that the barrel lock must first be unlocked prior to installation.

With the forgoing concerns in mind, it is the general object of the present invention to provide a key system for a rotating barrel lock that includes a master key, which allows the barrel lock to be delivered to installers in an unlocked state, and a simplified dummy key which allows the barrel lock to be locked but not unlocked thereby reducing costs and providing an increased level of security. It is also a general object of the present invention to provide a key system that will work with certain known barrel locks.

SUMMARY OF THE INVENTION

It is an object of the present invention to provide a key system for a rotating barrel lock.

It is an object of the present invention to provide a key system for a rotating disk barrel lock that provides an enhanced degree of security and simplifies the installation process.

It is an object of the present invention to provide a key system for a rotating disk barrel lock that reduces manufacturing costs and provides an ease of manufacture.

It is an object of the present invention to provide a key system for a rotating disk barrel lock that provides an enhanced degree of security through the use of a master key that can be removed when the lock is in an unlocked state.

It is an object of the present invention to provide a key system for a rotating disk barrel lock that provides an enhanced degree of security through the use of a master key that can be removed when the lock is in an unlocked state so that the barrel can be delivered for installation unlocked.

It is an object of the present invention to provide a key system for a rotating disk barrel lock that provides an enhanced degree of security, reduced manufacturing costs, and an ease of manufacture through the use of a simplified key that is capable of locking the barrel lock but not unlocking the lock.

It is another object of the present invention to provide a key system for a rotating disk barrel lock which may be utilized with certain known rotating disk barrel locks.

DETAILED DESCRIPTION OF THE INVENTION

Figure 1A:
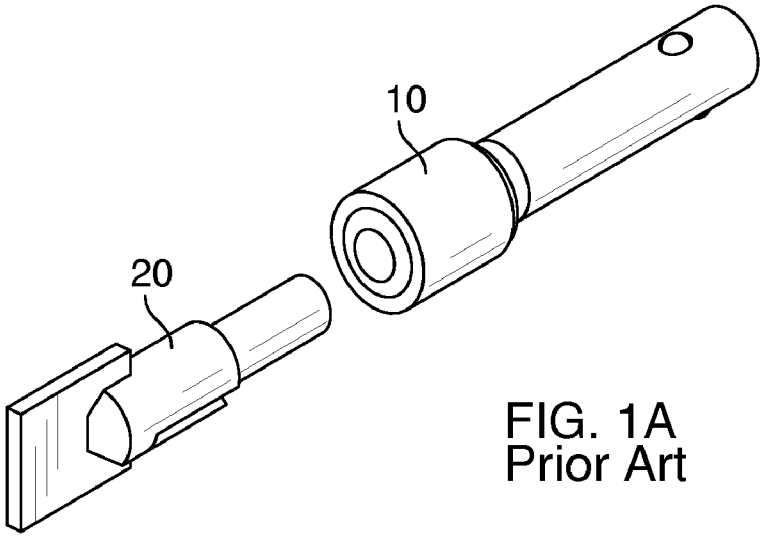
FIG. 1A Prior Art
FIGS. 1A and 1B are a perspective view and a cutaway side view of a known rotating disk barrel lock.
Figure 1B:
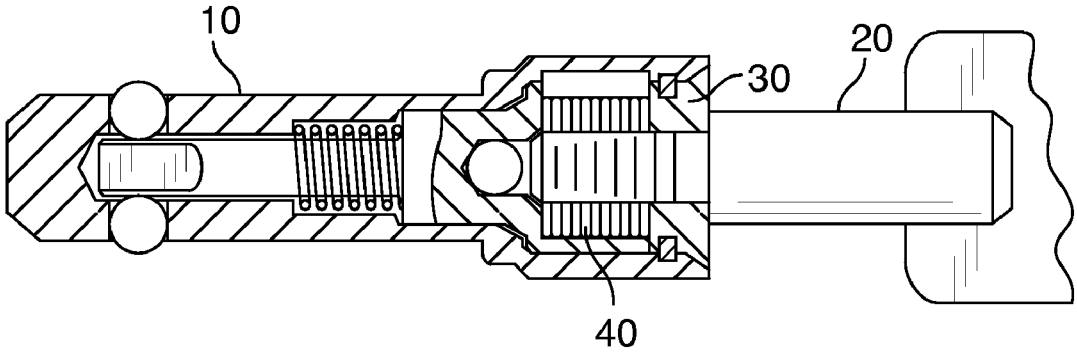
FIG. 1B Prior Art

FIGS. 1A and 1B depict a known rotating disk barrel lock 10 and known operating key 20. The barrel lock 10 includes a cylinder portion 30, which contains a series of rotatable elements 40 that are arranged in a stacked relationship.

Figure 2A:
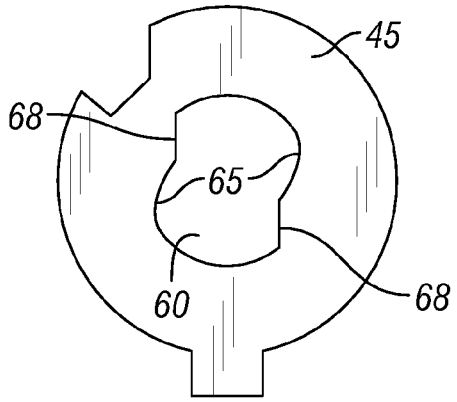
FIGS. 2A-2C are plan views of a rotating disk, lifting disk and combination disk of the known lock of FIG. 1.
Figure 2B:
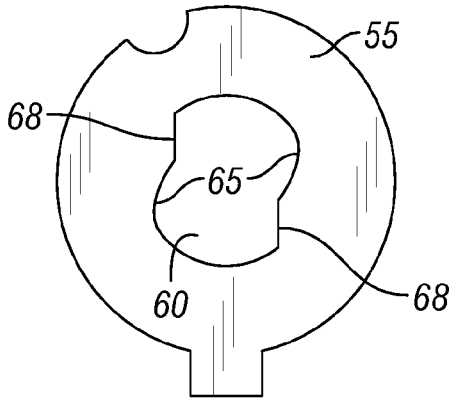
Figure 2C:
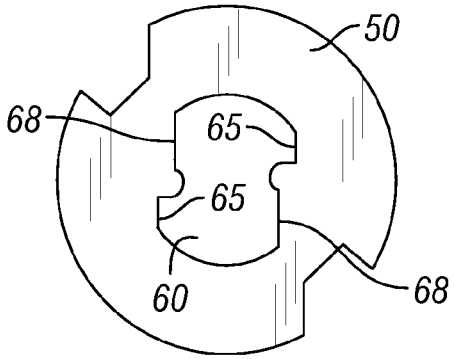

Referring now to FIGS. 2A-2C, the rotatable elements 40 include a lifting disk 45 which is located at the inner end of the cylinder, a rotating disk 50 at the outer end of the cylinder and a plurality of combination disks 55 between the rotating and lifting disks. The combination disks 55 are separated from each other, and from the rotating and lifting disks, by washers (not shown). As depicted, all of the disks include a central aperture 60 with curved or spiral cam surfaces 65 on opposite sides of the aperture and flat contact portions 68 directly adjacent to each spiral cam surface 65 on both sides of the aperture 60. The central apertures 60 of the disks align axially to define a keyway 62, which is configured to accept the shank of a key.

Figure 3:
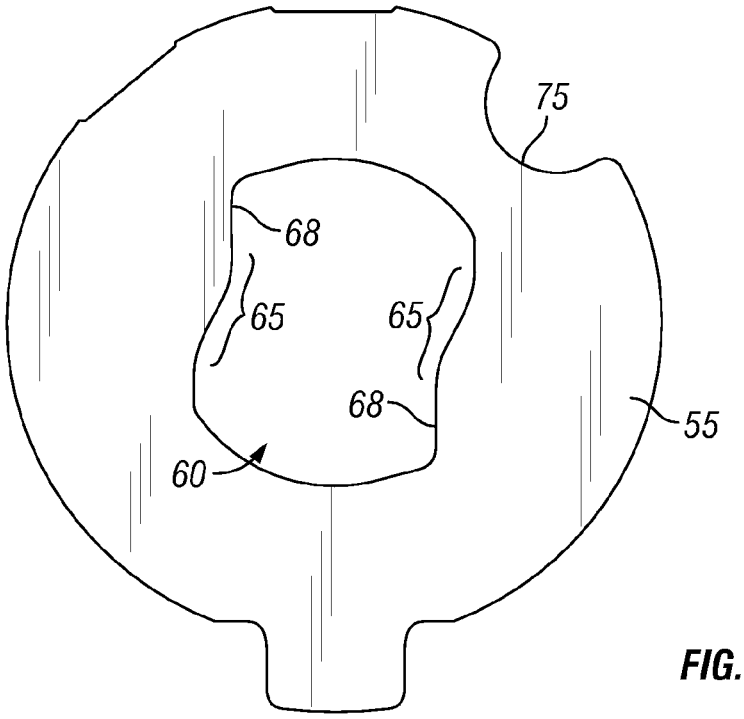
FIG. 3 is an enlarged view of a combination disk of the known lock of FIG. 1.
Figure 4:
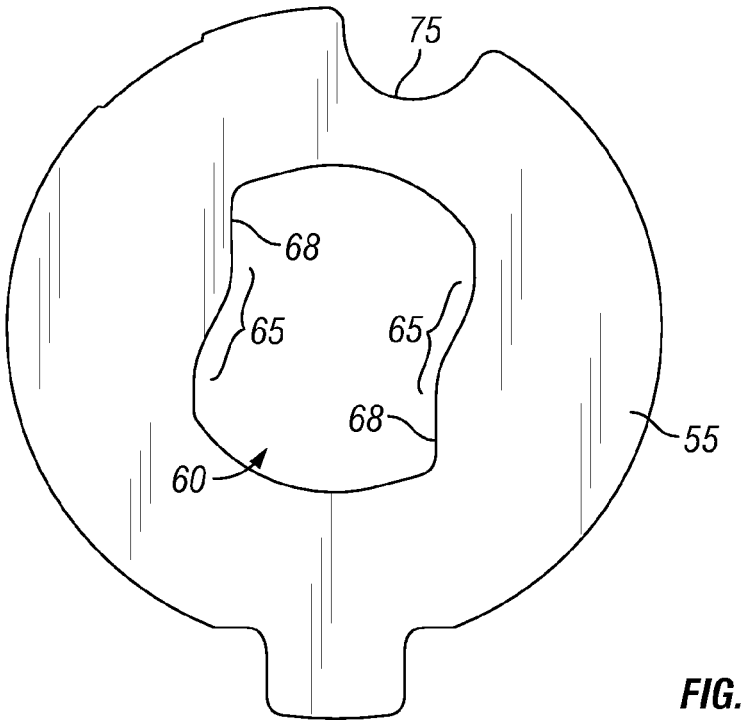
FIG. 4 is an enlarged view of a second combination disk of the known lock of FIG. 1.
Figure 5:
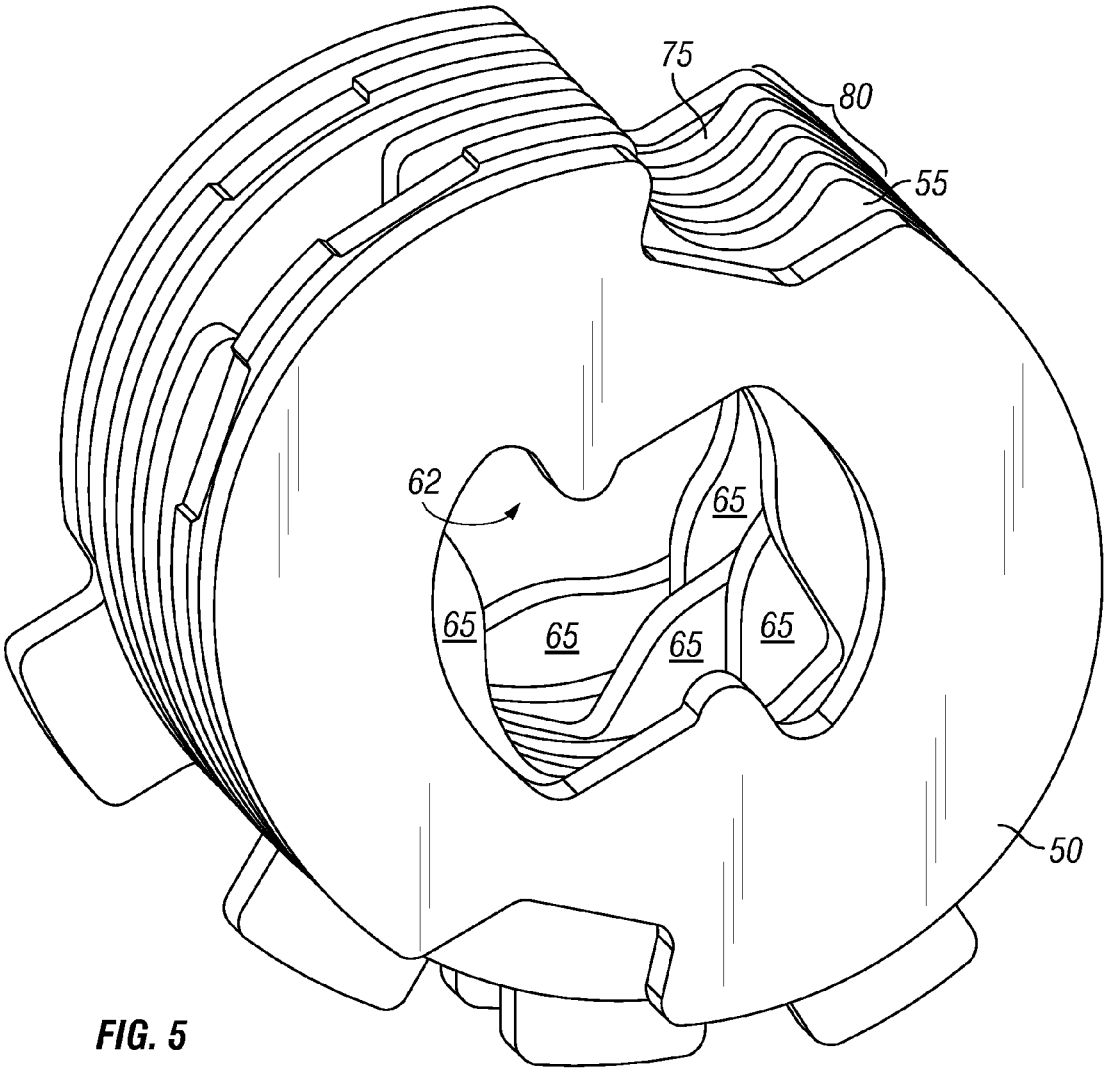
FIG. 5 is an enlarged, perspective view of a stack of disks of the known lock of FIG. 1 showing the disks in an unlocked position.
Figure 6:
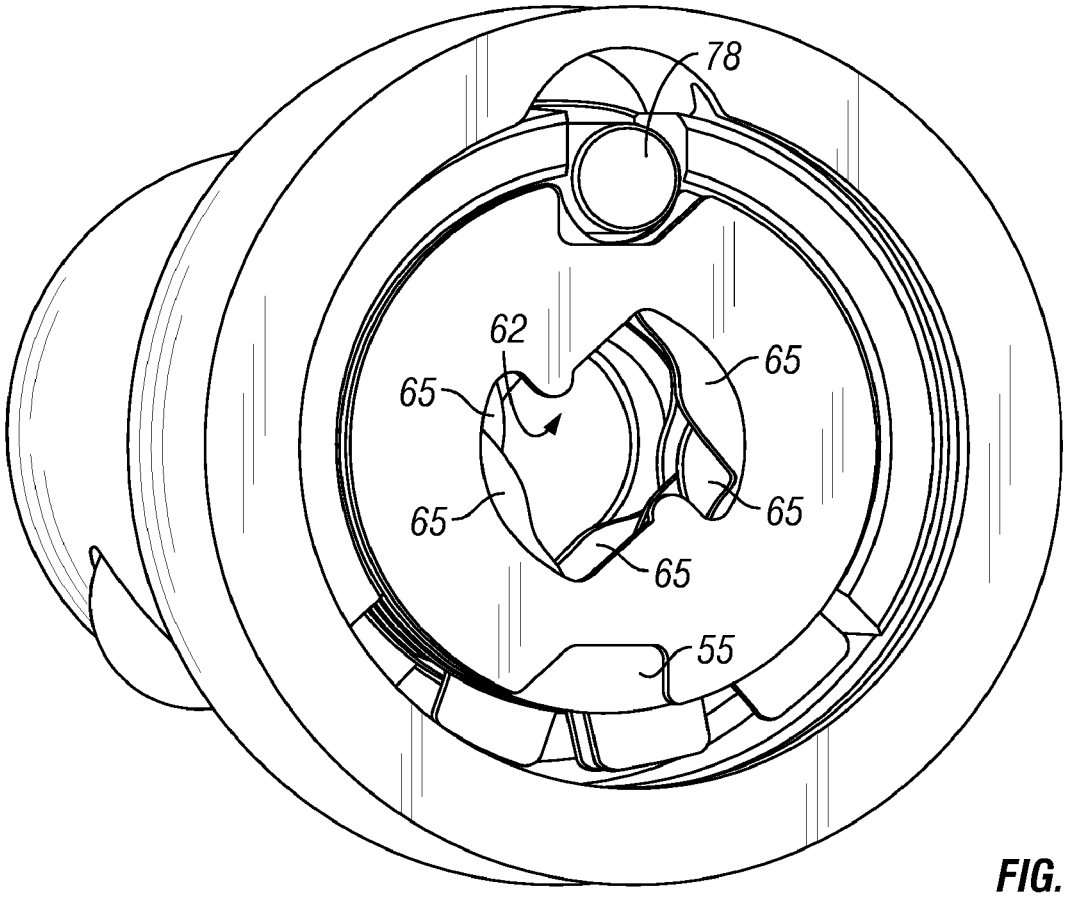
FIG. 6 is an enlarged, perspective view of a cylinder end of the known lock of FIG. 1 depicting the lock in an unlocked position.

Referring now to FIGS. 3-5, the combination disks 55 differ from one another in the orientation of their spiral cam surfaces 65 relative to a notch 75 on each disk which, when aligned, form a channel 80 which receives a locking bar 78 (FIGS. 5 and 6). As will be appreciated, given the varying placement of the notches 75 on the disks, when they are aligned, the spiral cam surfaces 65 are not in alignment and the key way 62 is partially obstructed thwarting removal of existing operating keys 20 which are shaped to closely fit within a completely aligned keyway.

FIGS. 5 and 6 illustrate a stack of disks in an unlocked position in which the locking bar 78 resides in the channel 80. As shown, the spiral cam surfaces 65 are not aligned in this position. As such, existing operating keys capable of both locking and unlocking the above-described locks cannot be removed as the misaligned spiral cam surfaces 65 that form the keyway 60 contact cam surfaces on the operating key 20 preventing it from being withdrawn from the lock.

Figure 7:
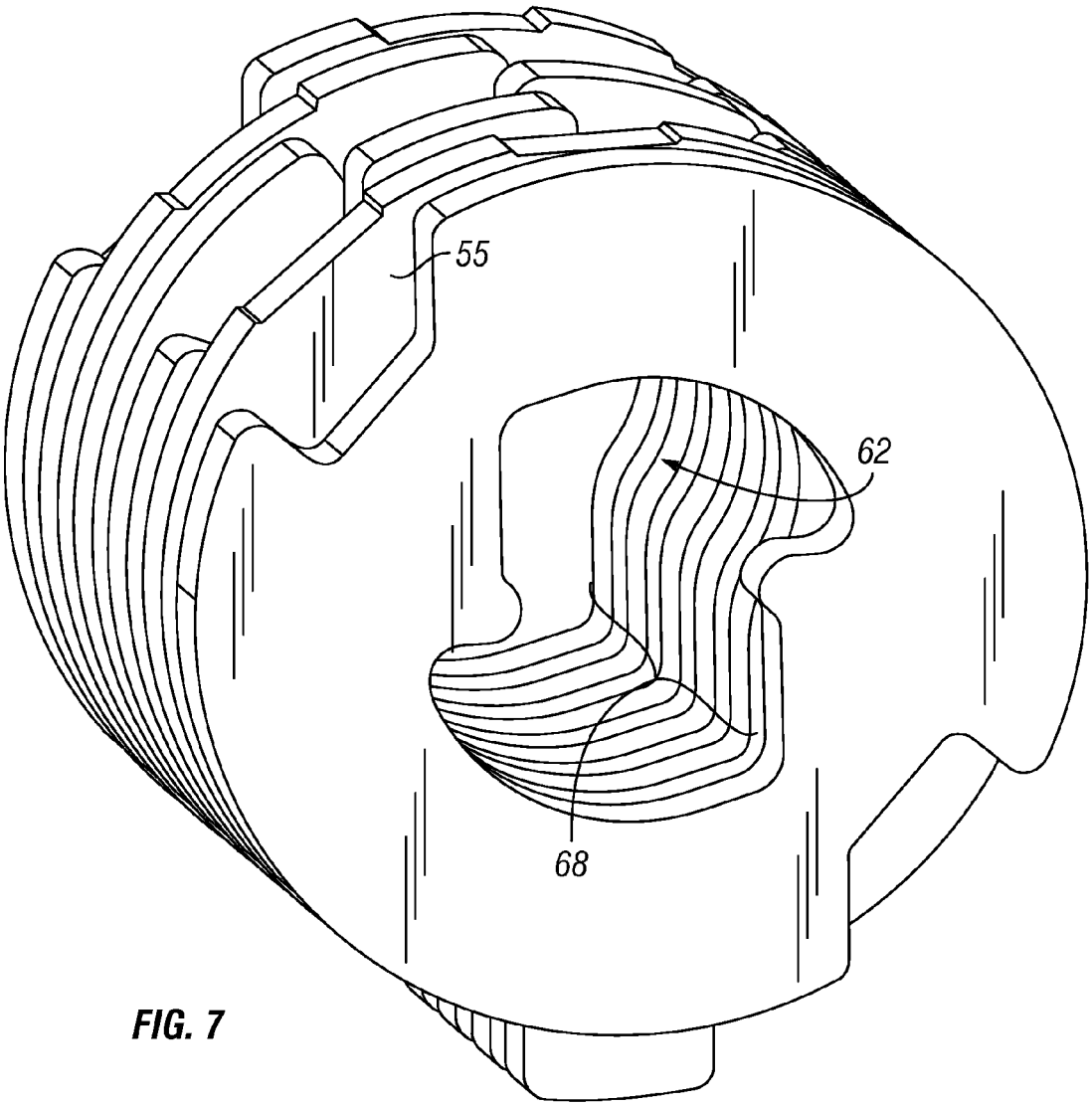
FIG. 7 is an enlarged, perspective view of the stack of disks of FIG. 5 showing the disks in a locked position.
Figure 8:
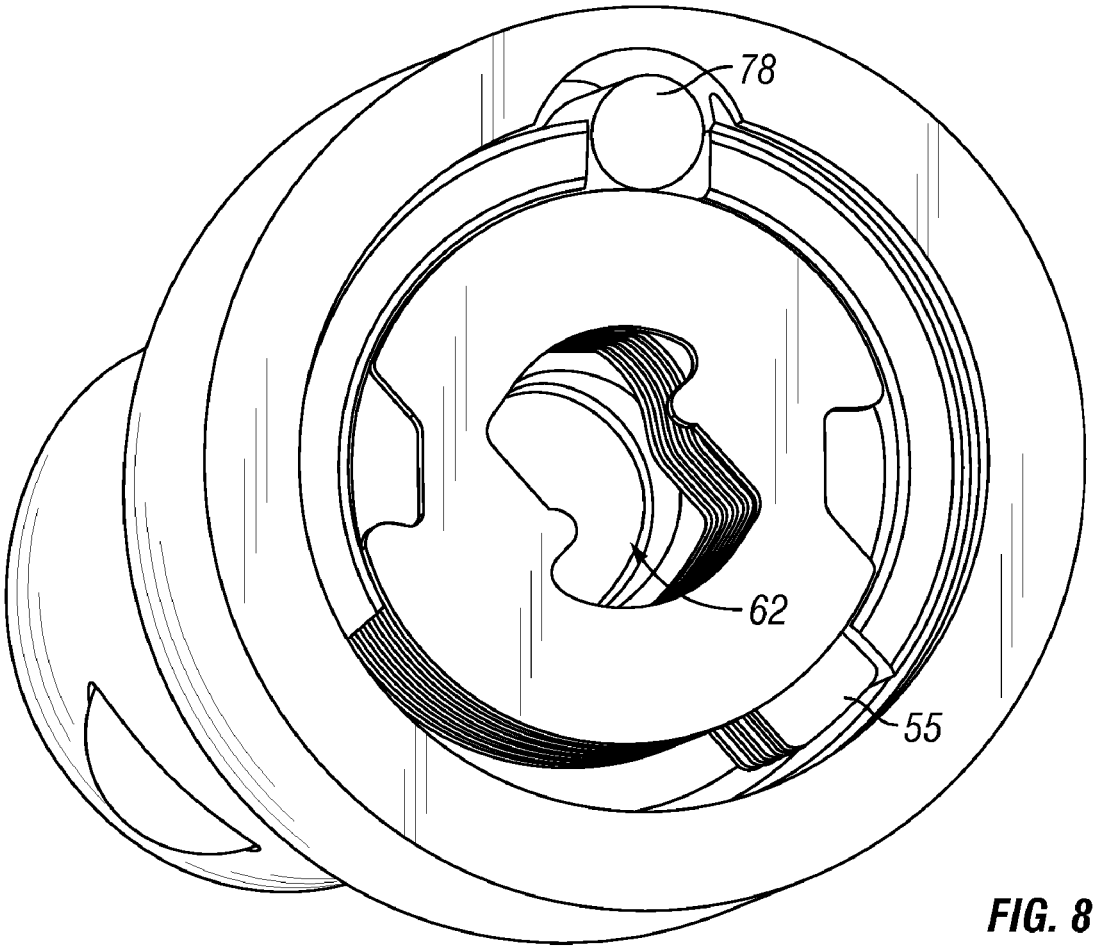
FIG. 8 is an enlarged, perspective view of a cylinder end of the known lock of FIG. 1 depicting the lock in an unlocked position.
Figure 9:
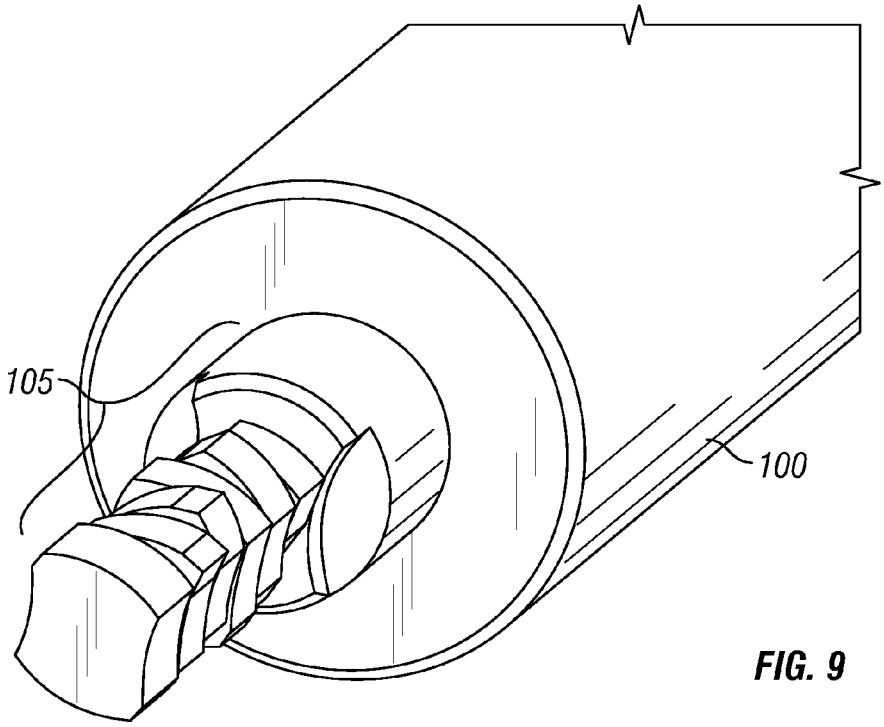
FIG. 9 is an enlarged, perspective view of a master key of a key system for a rotating disk barrel lock in accordance with an embodiment of the present invention.
Figure 10:
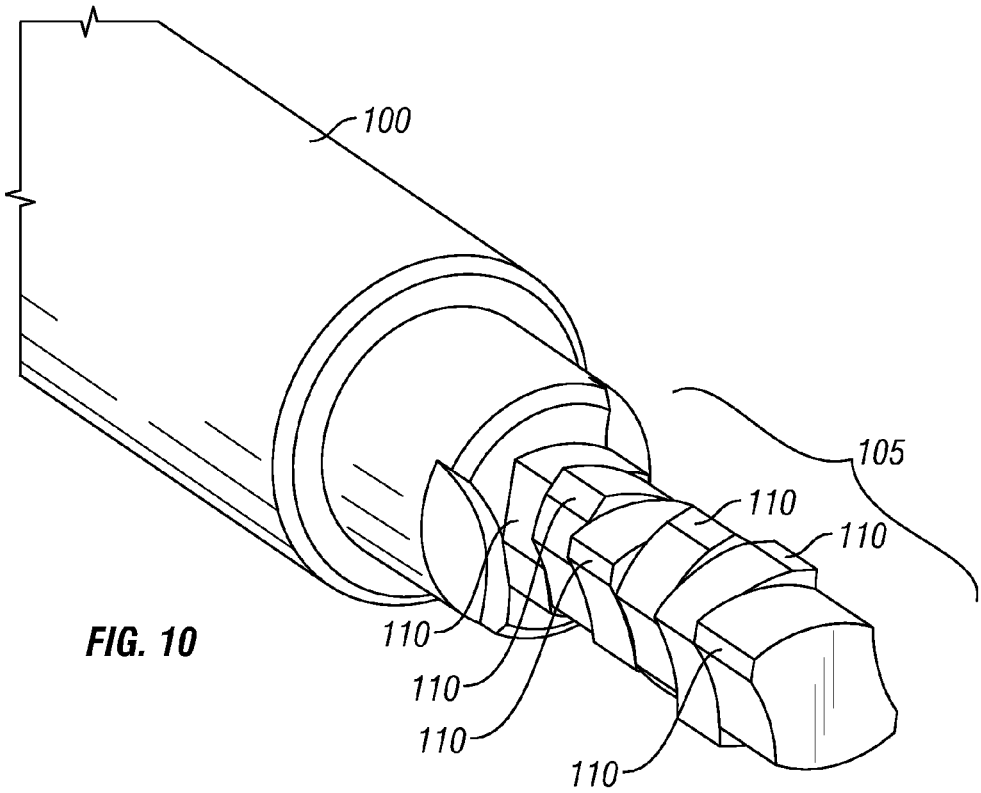
FIG. 10 is an enlarged, perspective view of cam surface sections of the master key of FIG. 9.

Indeed, the locked position shown in FIGS. 7 and 8 is the only position in which spiral cam surfaces 65 of the disks are completely aligned. In this locked position, the keyway 62 is fully formed and the close fitting operating key 20 can be removed.

As will be appreciated, known locks are delivered for deployment in the field locked, as they cannot be set to an unlocked position and shipped with current operating keys. In view of the above, installers must carry a key capable of both locking and unlocking the locks which presents security concerns if a key is lost or stolen. Moreover, known operating keys are relatively complicated and expensive to manufacture as they include intricate cam surfaces. As described in greater detail below, the present invention provides a key system that allows a rotating disk barrel lock to be delivered unlocked for installation and provides installers with a simplified contractor key only capable of locking the above-described lock.

The inventive key system is comprised of two keys, the first of which, referred to as the master key 100, is depicted in FIGS. 9-14D. The master key 100 has a shank portion 105, which includes longitudinally spaced cam surface sections 110. The number of cam surface sections 110 corresponds to the number of disks in the barrel lock. Each cam surface section 110 engages a separate disk. As will be apparent, this number may vary depending on the configuration of the barrel lock. The shank 105 is shown with a number of cam surfaces sections 110, which corresponds to the known barrel lock described above.

Figure 11:
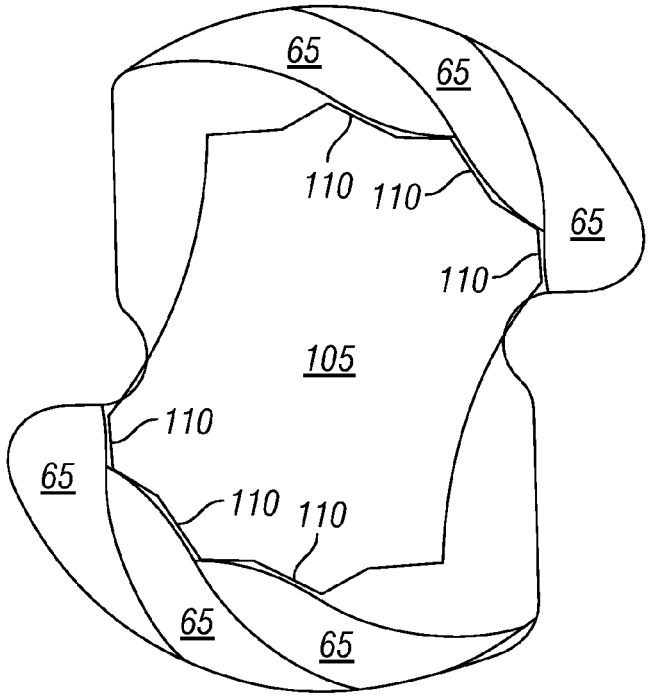
FIG. 11 is a front, cross-sectioned view of the master key of FIG. 9 showing the key engaging combination disks of the known lock of FIG. 1.
Figure 12A:
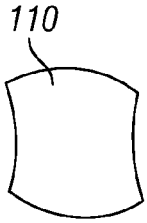
FIGS. 12A-12D are front, cross-sectioned views of the cam surface sections of a shank of the master key of FIG. 9.
Figure 12B:
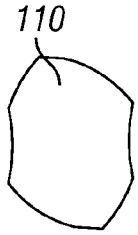
Figure 12C:
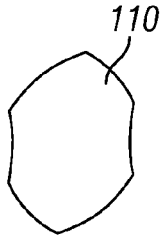
Figure 12D:
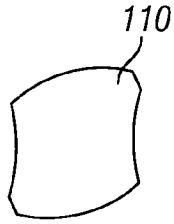
Figure 12E:
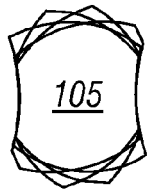
FIG. 12E is a composite view of the cam surface sections of FIGS. 12A-12D.

As shown in FIG. 11, the shank cam surfaces 110 are sized and shaped to engage certain portions of the spiral cam surfaces 65 of the disks. Each cam surface 110 is shaped to engage the spiral cam surfaces 65 of a specific disk and allow each disk to be rotated. The shapes of the cam surface sections 110, as viewed from the front of a key shank 105, are shown in FIGS. 12A-12D. As shown there are four basic shapes several of which may be repeated along the shank of the master key. The composite frontal profile of the cam surfaces sections 110 of the shank 105 is shown in FIG. 12E.

Figure 13:
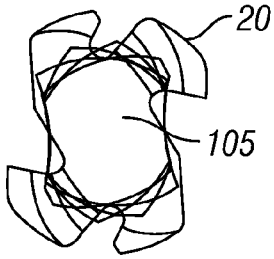
FIG. 13 is a view of a profile of the shank of the master key of FIGS. 12A-12D superimposed on a shank profile of a known key.

Referring now to FIG. 13, the shank 105 of the master key 100 has a much smaller profile than that of the known key 20, which is shown superimposed on the inventive shank 105. The reduced profile allows the key 100 to be withdrawn from a lock while it is in an unlocked state and the keyway is partially obstructed.

As will be readily appreciated, the reduced profile of the master key 100 is an important aspect of the present invention as it allows the key to be withdrawn from an unlocked lock. This allows locks to be shipped to installers unlocked which, as discussed below, facilitates the use of a complementary contractors key which can only be used to lock an already unlocked lock.

Figure 14:
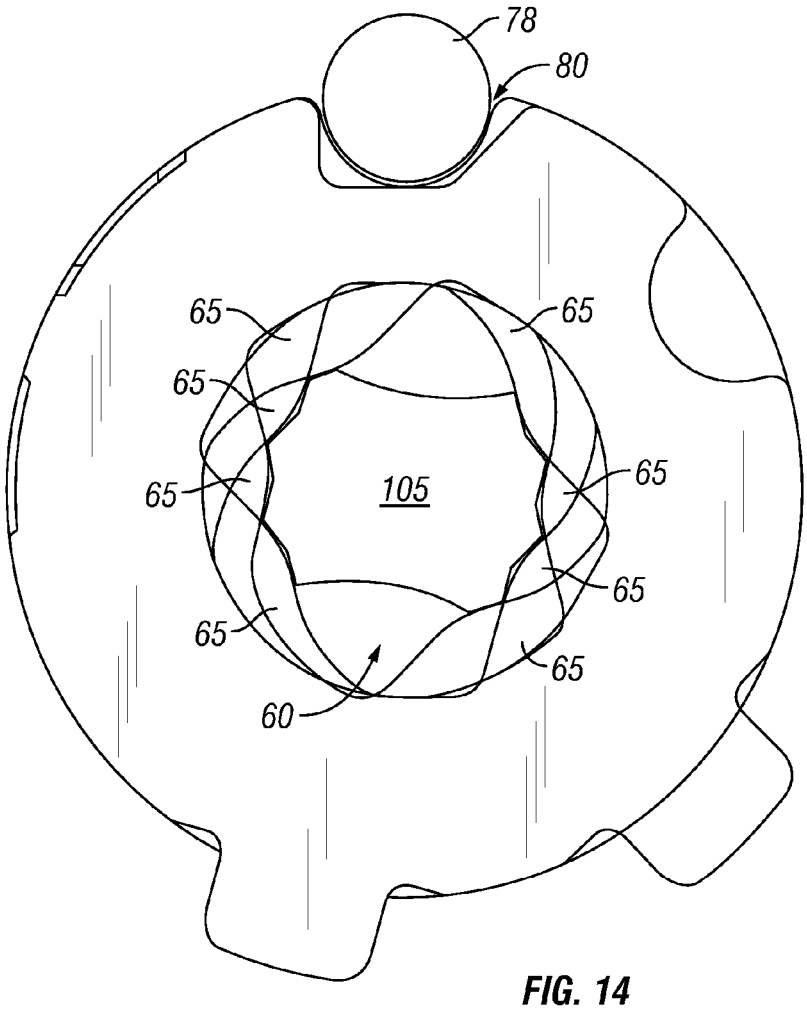
FIG. 14 is a front, cross-sectioned view of the shank engaging spiral cam surfaces of the known lock of FIG. 1.
Figure 14A:
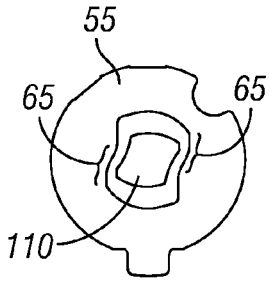
FIG. 14A-14D are front, cross-sectioned views of a cam surface section engaging a combination disk of the known lock of FIG. 1 and rotating the disk to an unlocked position.
Figure 14B:
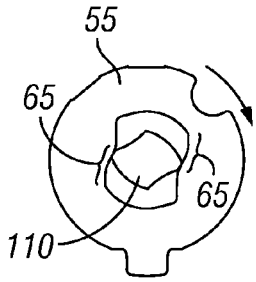
Figure 14C:
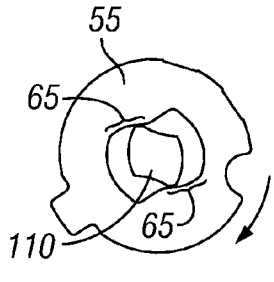
Figure 14D:
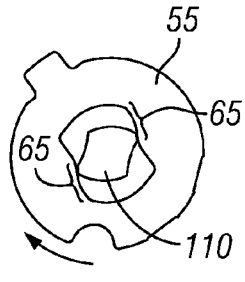

The interaction between the master key 100 and the disks of a lock is shown in FIG. 14. Specifically, an unlocked disk configuration is depicted with the locking bar 78 deployed in the channel 80. In this state, the keyway 60 is partially obstructed by the spiral cam surfaces 65 of the disks. The shank 105 is shaped, however, such that it may be removed from the lock even though the keyway is partially blocked. This is due to the fact that the cam surfaces 110 of the shank 105 do not extend beyond the peripheral boundaries of the spiral cam surfaces 65 of the disks.

For reference, the smaller profile of the shank 105 as compared to the profile of the known operating key 120 is as shown in FIG. 13. The known key 120 has a much larger profile and has cam surfaces on its shank, which are shaped to closely mate with the spiral cam surfaces 65 of the known lock. This larger profile prevents the key 120 from being removed when the lock is unlocked and the keyway is partially obstructed.

While the shank of the master key has a reduced overall profile to facilitate removal, each of its cam surface sections 110 is designed to engage with enough of the spiral cam surfaces 65 of a combination disk so that all of the disks may be rotated clockwise to place the lock in an unlocked position. This is graphically illustrated in FIGS. 14A-14D which shows the interaction between a single cam surface section 110 and a combination disk 55.

In particular, the cam surface section 110 engages a relatively small portion of the spiral cam surface 65 of the disk 55.

As the cam surface section 110 rotates, the disk 55 correspondingly rotates clockwise until the lock is unlocked. The key 100 is incapable of rotating the disks counter-clockwise, however, as the shaft 110 lacks sufficient cam surfaces or cuts for effective counter-clockwise disk rotation.

In view of the above, the master key cannot lock known locks. This is not a concern, however, as the master key is intended for use as a tool to prepare locks for distribution to installers in the field. That is, the master key is most likely to be employed in a lock manufacturing or distribution facility and not in the field.

As mentioned above, the ability to remove the master key from an unlocked lock is an important aspect of the present invention as it allows locks to be delivered unlocked. This in turn makes it possible to develop simplified contractor keys capable of only locking known locks.

Furthermore, while the master key is an important aspect of the present invention, it may be possible to assemble a rotating disk lock in an unlocked position without the use of a master key. That is, during the manufacturing and assembly process, the disks may be placed into the cylinder in an unlocked state eliminating the need for a key.

Figure 15:
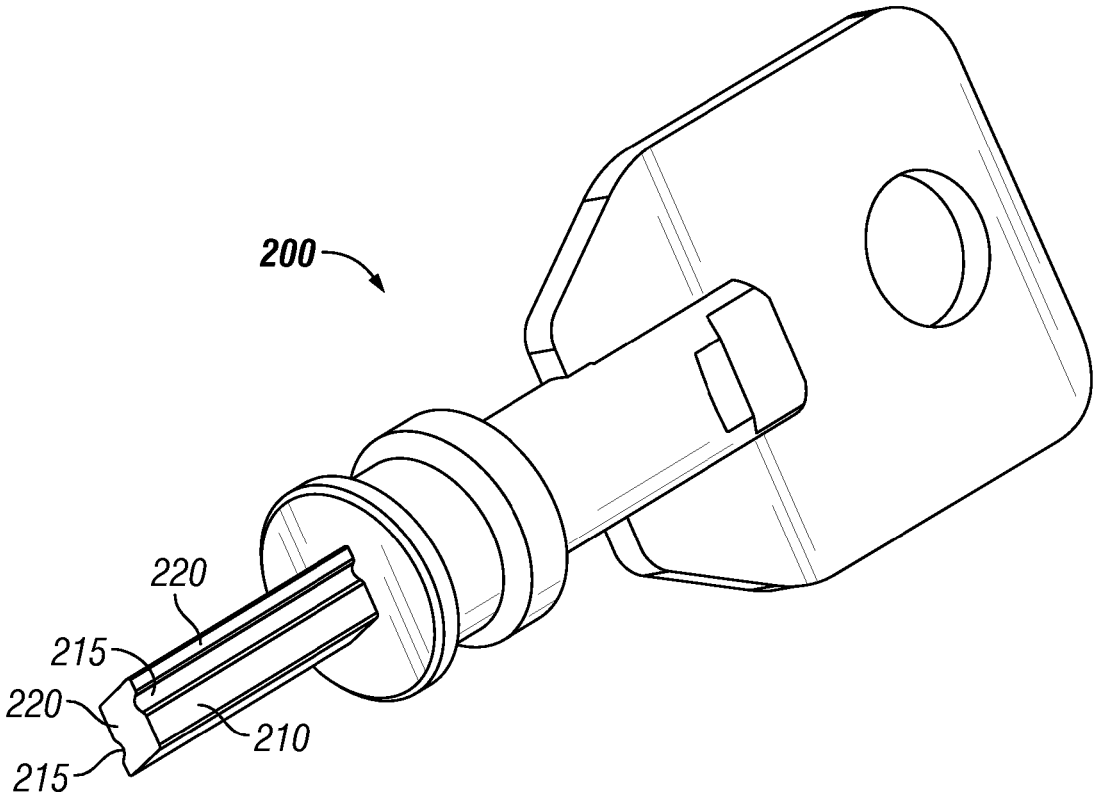
FIG. 15 is a perspective view of a simplified contractor key in accordance with an embodiment of the present invention.

Turning now to FIG. 15, the present key system also includes a dummy or contractor key 200 has a simplified, reduced profile shank 210. More specifically, the shank 210 has the profile of a parallelogram and includes longitudinal grooves 215. The shank 210 includes two opposite cam surfaces 220 which engage the flat contact surfaces 68 located on opposite sides of the apertures 62 of the disks.

The relatively simple profile of the shank is an important aspect of the present invention. The simple profile reduces manufacturing costs and provides an ease of manufacture not present with known operating keys. This is important as the contractor keys are likely to be widely deployed and if a key is lost or damaged, the utility is not burdened by the cost of purchasing an expensive replacement.

Figure 18:
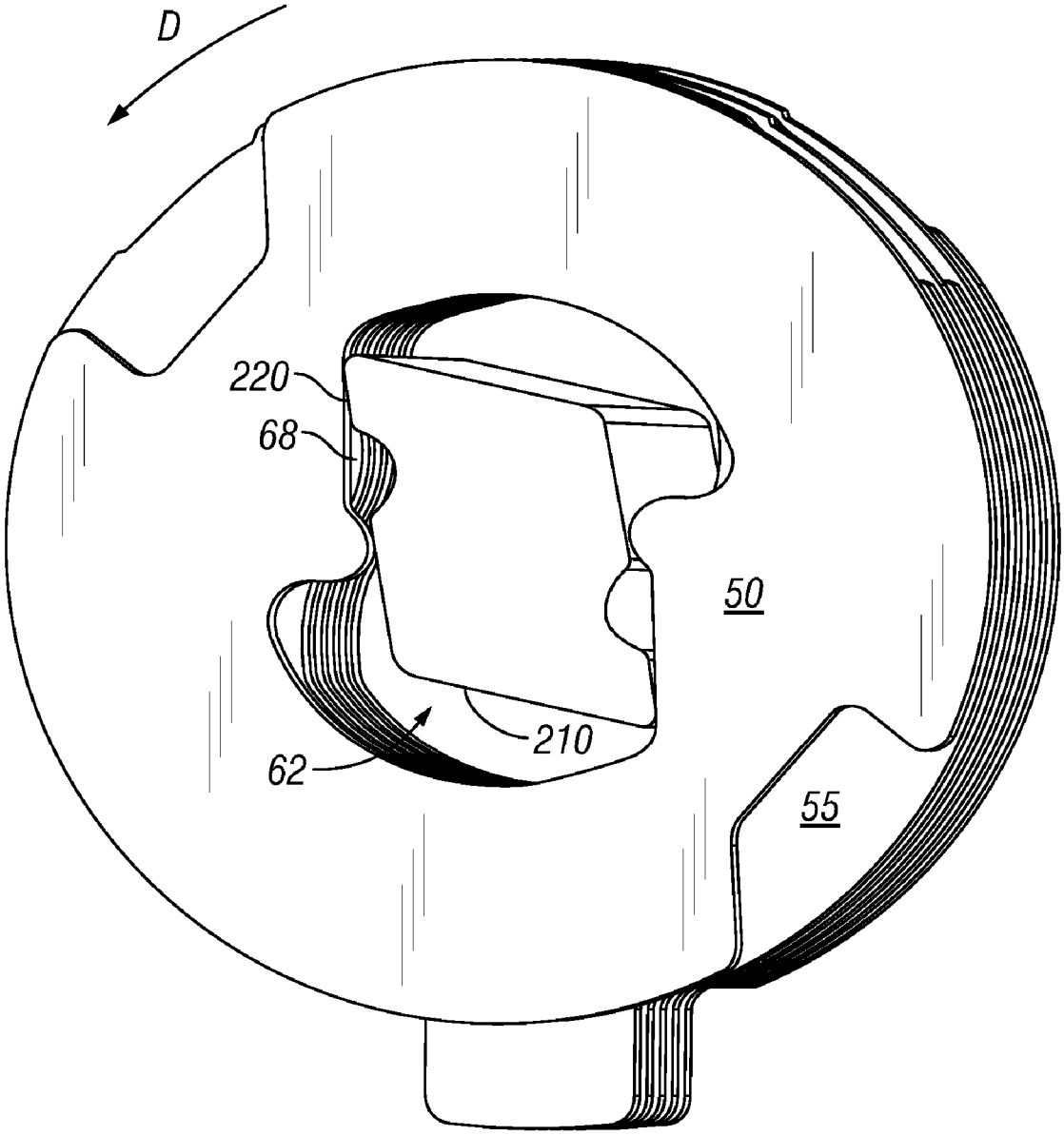
FIG. 18 is a perspective, cross-sectioned view of the simplified contractor key and lock of FIG. 16 showing the interaction of a cam surface of the key with a flat contact portion of an aperture of a combination disk.

Referring now to FIG. 18, the cam surfaces 220 of the shank 210 abutingly engage the flat contact surfaces 68 of the aperture 62 and allow the shank 210 and disks 50, 55 to be rotated counterclockwise in direction D. In this figure the disks are shown in a locked configuration.

Turning back to FIG. 16, the shank 210 is shaped to fit into an unlocked lock where the aperture is partially obstructed by the cam surfaces of the disks. As shown, the shank 210 can be placed in an unlocked lock and rotated counter-clockwise causing the cam surfaces 220 to engage the flat contact surfaces 68. Typically, one of the disks will first contact the cam surfaces 220 and rotate until the cam surfaces 220 pick up a second disk and third disk, until all disks rotate counterclockwise together.

Figure 16:
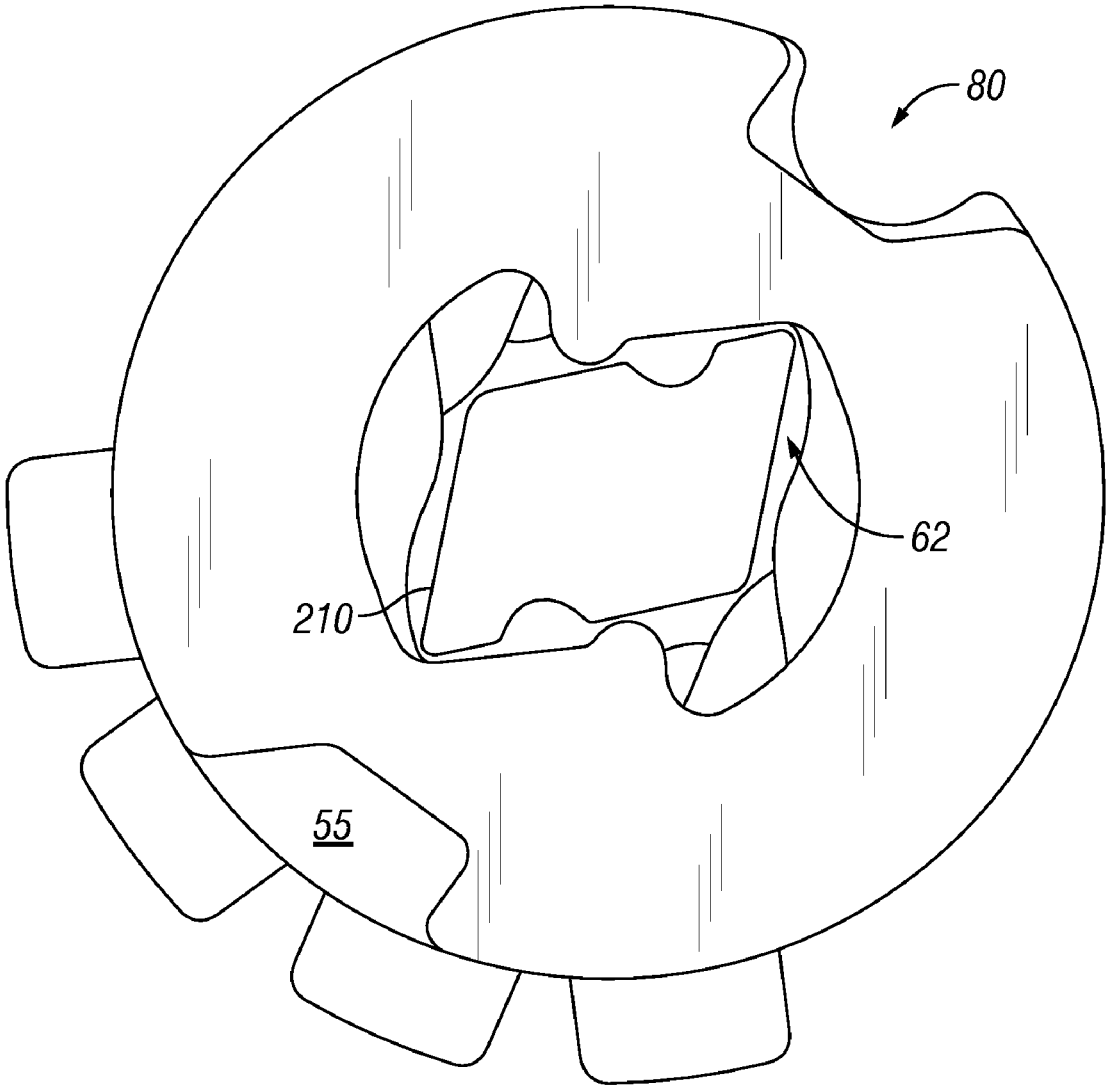
FIG. 16 is a front, cross-sectioned view of the simplified contractor key of FIG. 15 inserted in the known lock of FIG. 1 in an unlocked state.
Figure 17:
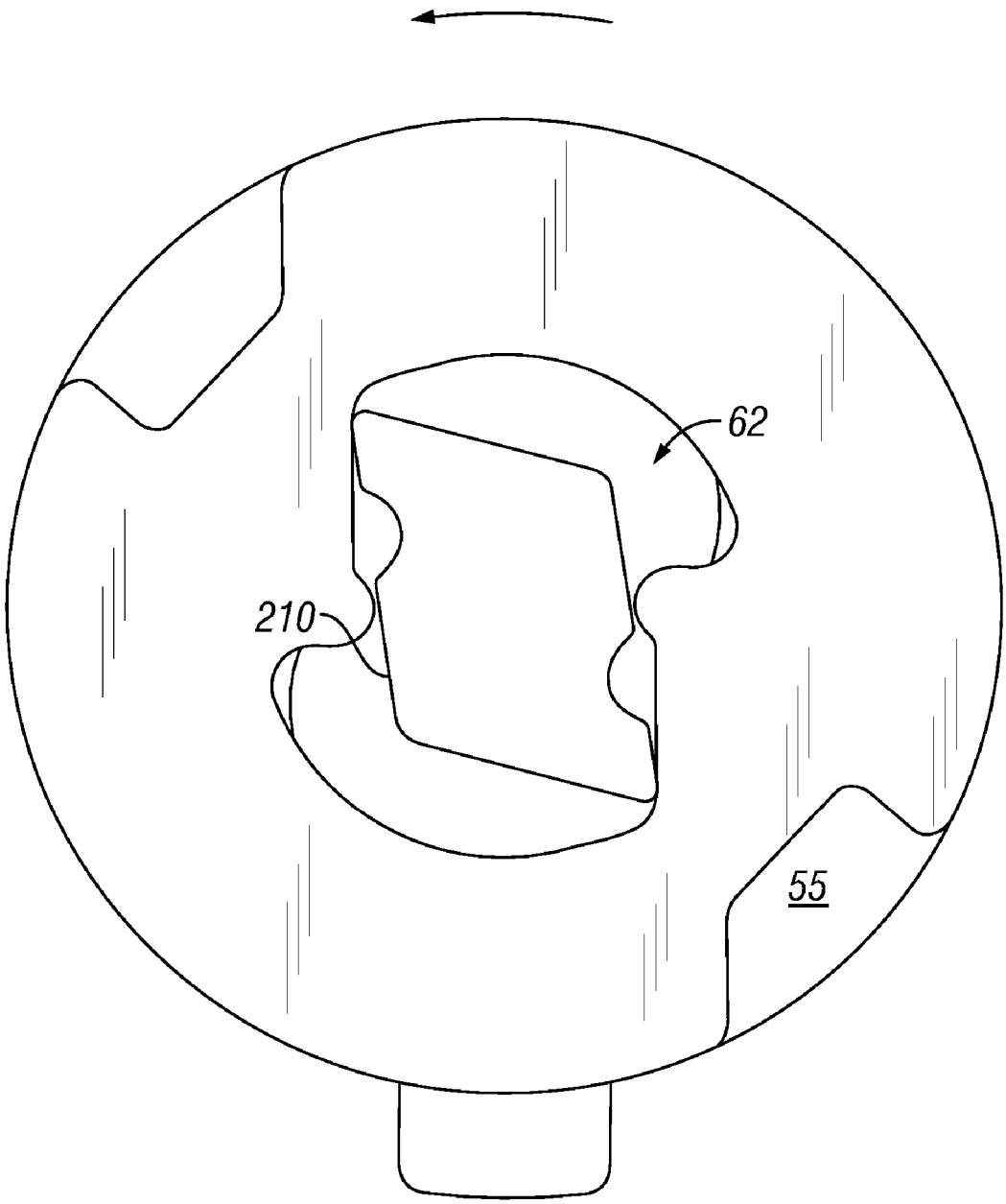
FIG. 17 is a front, cross-sectioned view of the simplified contractor key and lock of FIG. 16 in which the key has been rotated counter-clockwise to place the lock in a locked state.

FIG. 17 illustrates a locked position after the insertion and rotating of the contractor key 200 in an unlocked lock as shown in FIG. 16. As depicted, the apertures of the disks 55 are aligned and the keyway 62 is completely formed. In this state, the lock is locked and the disks are considered scrambled, i.e., the notches that form the channel for the locking bar are misaligned.

Importantly, the parallelogramatic profile of the contractor key 210 does not allow the key 210 to rotate the disks clockwise to unlock the lock. The portions of the shank 210 opposite the cam surfaces 220 are devoid of any camming structures or cuts, and, if rotated clockwise, will not engage a portion of the apertures of the disks to permit clockwise rotation sufficient to attain a disk combination that unlocks the lock. As such, the key cannot unlock known rotating disk barrel locks as described herein.

As will be readily apparent, the restricted ability to only lock known rotating barrel locks is a critical feature of the present invention. The present contractor key may be deployed in the field without the threat of a major security breach should the key be stolen or lost. As stated, utilities typically have a single combination, and corresponding single key, for all locks deployed by the utility. If a key capable of unlocking a lock is lost or stolen, it may be used to gain unauthorized access to all of the utility's meter boxes. With the inventive contractor key, this is not possible as it cannot be used to unlock previously installed and locked barrel locks.

Moreover, the ability to use the present key system with known types of barrel locks is a significant feature of the present invention. In particular, the inventive key system can be used for new orders of known locks without any compatibility issues. That is, if a utility uses the aforementioned known lock and places an additional order for the locks, which are delivered in an unlocked state and then installed/locked with the inventive contractor key, existing operating keys may be used to unlock the installed new locks.

In sum, the present invention provides a key system that includes a master key capable of removal from an unlocked known rotatable disk barrel lock. This master key allows such locks to be delivered to installers in an unlocked state. The inventive key system further includes a simplified contractor key which only allows the locks to be locked from an unlocked state. As such, the inventive key system reduces key costs and provides an enhanced level of security presently unknown in the art.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A key for use with a barrel lock having a rotating locking mechanism, said rotating locking mechanism including at least one combination disk, each disk having a cam surface and a substantially flat contact surface, said key comprising:

a grip portion;

a shank portion operatively attached to said grip portion;

at least one shank cam surface along said shank portion;

wherein said key is capable of insertion into an unlocked barrel lock, and said key is selectively actuatable so that said shank cam surface contacts said substantially flat contact surface when said key is rotated in a first direction, to place said barrel lock in a locked position, and is incapable of unlocking said barrel lock if rotated in a direction opposite said first direction.

2. The key for use with a barrel lock of claim 1 wherein said rotating locking mechanism includes a plurality of combination disks arranged in a stacked relationship, each of said combination disks including a central aperture, said central apertures including opposing cam surfaces, and wherein said stacked central apertures align to form a keyway.

3. The key for use with a barrel lock of claim 2 wherein said at least one shank cam surface are two opposing cam surfaces which extend longitudinally along said shank portion and engage substantially flat contact surfaces of said central apertures, when said shank portion is inserted in said keyway, to lock said barrel lock.

4. The key for use with a barrel lock of claim 2 wherein said keyway is partially obstructed by said combination disks when said barrel lock is unlocked; and wherein said shank portion can be inserted in said partially obstructed keyway of said unlocked barrel lock and lock said barrel lock.

5. The key for use with a barrel lock of claim 3 wherein said shank portion has a substantially parallelogramatic profile in which said cam surfaces are on opposing parallel sides of said shank portion.

6. A key for use with a barrel lock having a rotating locking mechanism that includes a keyway and at least one combination disk, each disk having a cam surface, said key comprising:

a grip portion;

a shank portion operatively attached to said grip portion;

at least one shank cam surface along said shank portion;

wherein said key is selectively actuatable so that said shank cam surface contacts said disk cam surface when said key is rotated in a first direction, to place said barrel lock in an unlocked position; and wherein said shank portion may be withdrawn from said keyway when said barrel lock is in said unlocked position.

7. The key for use with a barrel lock of claim 6 wherein said rotating locking mechanism includes a plurality of combination disks arranged in a stacked relationship, each of said combination disks including a central aperture which defines said keyway.

8. The key for use with a barrel lock of claim 7 wherein said keyway is partially obstructed by said combination disks when said barrel lock is unlocked; and wherein said shank portion can removed from said partially obstructed keyway of said barrel lock when said lock is unlocked.

9. The key for use with a barrel lock of claim 7 wherein said at least one shank cam surface is a plurality of shank cam surfaces whose number corresponds to a number of said stacked combination disks.

10. The key for use with a barrel lock of claim 9 wherein said shank cam surfaces are longitudinally spaced along said shank portion and each of said shank cam surfaces has a shape, and wherein said shapes of adjacent shank cam surfaces are different from one another.

11. The key for use with a barrel lock of claim 10 wherein said shank cam surfaces engage corresponding cam surfaces on opposing sides of said combination disk apertures allowing said lock to be unlocked.

12. A method of increasing the security of a barrel lock having a rotating locking mechanism including a plurality of rotatable disks each of said disks having a cam surface, said method comprising the steps of:

forming a key having a operable section capable of contacting at least one portion of said cam surface of each of said rotatable disks when rotated in a first, locking direction, and forming said operable section of said key so that said operable section is incapable of contacting said disks sufficiently when said key is rotated in a second locking direction, which prevents unlocking of said barrel lock.

13. The method of claim 12 wherein said operable section is at least one cam surface section located on a shank of said key.

14. The method of claim 13 wherein said at least one cam surface section is a separate cam surface section for each of said plurality of said cam surfaces on said rotatable disks.

15. A barrel lock and key system for locking a rotating barrel lock, said system comprising:

a barrel lock having a rotating locking mechanism;

a key for use with said barrel lock;

wherein said barrel lock includes at least one combination disk, each disk having a disk cam surface and a substantially flat contact surface;

wherein said key includes a grip portion, a shank portion operatively attached to said grip portion, and at least one shank cam surface along said shank portion; and wherein said key is selectively actuatable so that said shank cam surface contacts said substantially flat contact surface when said key is rotated in a first direction, to lock said barrel lock, and is incapable of unlocking said barrel lock if rotated in a direction opposite said first direction.

16. The barrel lock and key system for locking a rotating barrel lock of claim 15 wherein said rotating locking mechanism includes a plurality of combination disks arranged in a stacked relationship, each of said combination disks including a central aperture, said central apertures including opposing cam surfaces, and wherein said stacked central apertures align to form a keyway.

17. The barrel lock and key system for locking a rotating barrel lock of claim 16 wherein said at least one shank cam surface engages said plurality of combination disks to lock said barrel lock.

18. The barrel lock and key system of claim 17 wherein said at least one shank cam surface are two opposing cam surfaces which extend longitudinally along said shank portion and engage substantially flat contact surfaces of said central apertures, when said shank is inserted in said keyway, to lock said barrel lock.

19. The barrel lock and key system for locking a rotating barrel lock of claim 16 wherein said keyway is partially obstructed by said combination disks when said barrel lock is unlocked; and wherein said shank portion can be inserted in said partially obstructed keyway of said unlocked barrel lock and lock said barrel lock.

20. The barrel lock and key system of claim 18 wherein said shank portion has a substantially parallelogramatic profile in which said cam surfaces are on opposing parallel sides of said shank portion.

21. A barrel lock and key system for locking a rotating barrel lock, said system comprising:

a barrel lock, said barrel lock including:

a barrel having an internal groove extending longitudinally in parallel relationship to a lock axis;

a cylinder portion received in said barrel for rotation about said axis, said cylinder portion having a slot extending in parallel relationship to said axis;

a locking bar located in said slot;

a plurality of independently rotatable discs arranged along said axis within said cylinder portion, said discs having coaxially aligned central apertures and outer peripheral edges interrupted by notches, each of said central apertures is bordered by at least two angularly offset internal cam surfaces and substantially flat contact portions adjacent to each of said cam surfaces;

wherein said discs being rotatably adjustable between a locked setting in which at least some of said discs are arranged with their notches angularly misaligned with respect to said slot, and with their peripheral edges bearing against and holding said locking bar in said internal groove to prevent rotation of said cylinder portion relative to said barrel, and an unlocked setting in which the notches of all of said discs are aligned longitudinally with each other as well as radially with said slot to thereby accommodate shifting of said locking bar from said internal groove into said aligned notches to permit said rotation; and, wherein said internal cam surfaces and substantially flat contact portions of each of said discs are substantially aligned with one another to form a keyway in said locked setting and said cam surfaces and substantially flat contact portions are substantially misaligned with one another in said unlocked setting and said keyway is partially obstructed; and a key, said key including:

a grip portion, a shank portion operatively attached to said grip portion, said shank portion having at least two shank cam surfaces each on an opposing side of said shank portion; and, wherein said key may be placed in said keyway in its unlocked setting and rotated in a first direction so that said shank cam surfaces contact said substantially flat contact portions and rotate said discs to said locked setting; and wherein said key is incapable of unlocking said barrel lock if rotated in a direction opposite said first direction as said shank cam surfaces do not engage a portion of the disc apertures sufficient to permit rotation to said unlocked setting.

22. The barrel lock and key system of claim 21 wherein said shank portion has a substantially parallelogramatic profile in which said cam surfaces are on opposing parallel sides of said shank portion.

* * * * *